US011130361B2

(12) United States Patent
Syrjanen et al.

(10) Patent No.: US 11,130,361 B2
(45) Date of Patent: Sep. 28, 2021

(54) IDENTIFICATION DOCUMENT WITH SEVERAL VISUAL MARKINGS AND METHOD FOR MANUFACTURING THEREOF

(71) Applicant: THALES DIS FRANCE SA, Meudon (FR)

(72) Inventors: Taru Syrjanen, Meudon (FR); Mikko Lankinen, Meudon (FR)

(73) Assignee: THALES DIS FRANCE SA, Meudon (FR)

( * ) Notice: Subject to any disclaimer, the term of this patent is extended or adjusted under 35 U.S.C. 154(b) by 0 days.

(21) Appl. No.: 16/958,450

(22) PCT Filed: Dec. 17, 2018

(86) PCT No.: PCT/EP2018/085278
§ 371 (c)(1),
(2) Date: Jun. 26, 2020

(87) PCT Pub. No.: WO2019/129529
PCT Pub. Date: Jul. 4, 2019

(65) Prior Publication Data

US 2021/0053382 A1 Feb. 25, 2021

(30) Foreign Application Priority Data

Dec. 29, 2017 (EP) ..... 17306974

(51) Int. Cl.
*B42D 25/435* (2014.01)
*B42D 25/351* (2014.01)
(Continued)

(52) U.S. Cl.
CPC ..... *B42D 25/435* (2014.10); *B42D 25/23* (2014.10); *B42D 25/351* (2014.10); *B42D 25/378* (2014.10); *B42D 25/44* (2014.10)

(58) Field of Classification Search
CPC ... B42D 25/378; B42D 25/351; B42D 25/435
See application file for complete search history.

(56) References Cited

U.S. PATENT DOCUMENTS 8,568,864 B2 * 10/2013 Syrjanen ..... B42D 25/391 428/201
10,272,712 B2 * 4/2019 Reddy ..... B42D 25/23
(Continued)

FOREIGN PATENT DOCUMENTS

EP 2511104 A1 10/2012
WO WO-2008084315 A2 * 7/2008 ..... B42D 25/00

OTHER PUBLICATIONS

PCT/EP20181085278, International Search Report, dated Jan. 16, 2019, European Patent Office, P.B. 5818 Patentlaan 2 NL—2280 HV Rijswijk.

(Continued)

*Primary Examiner* — Kyle R Grabowski
(74) *Attorney, Agent, or Firm* — The Jansson Firm; Pehr B. Jansson

(57) ABSTRACT

The invention concerns a method for manufacturing an identification document comprising a body with a first visual marking and a second visual marking, the first and the second visual markings depicting same identification data. The method comprises the following steps of:

engraving a first area of the identification document with a first laser beam for obtaining the first visual marking;

providing at least one see-through portion in a second area of the identification document;

providing an optically variable printing ink patch, laminated to at least one first transparent layer located in the see-through portion; and engraving the surface of the laminated optically variable printing ink patch with a second laser beam for obtain- (Continued)

ing the second visual marking, said second laser beam having a lower power than the first laser beam.

The invention concerns also the identification document obtained by this method.

14 Claims, 3 Drawing Sheets

(51) Int. Cl.

| | |
|---|---|
| ***B42D 25/378*** | (2014.01) |
| ***B42D 25/23*** | (2014.01) |
| ***B42D 25/44*** | (2014.01) |

(56) References Cited

U.S. PATENT DOCUMENTS

| | | | | |
|---|---|---|---|---|
| 2012/0126525 | A1* | 5/2012 | Dorfler | B42D 25/41 283/75 |
| 2018/0065397 | A1* | 3/2018 | Noizet | B41M 5/267 |
| 2018/0186164 | A1* | 7/2018 | Wu | G06K 19/06103 |
| 2020/0316983 | A1* | 10/2020 | Staub | B42D 25/351 |

OTHER PUBLICATIONS

PCT/EP2018/085278, Written Opinion of the International Searching Authority, dated Jan. 16, 2019, European Patent Office, D-80298 Munich.

* cited by examiner

IDENTIFICATION DOCUMENT WITH SEVERAL VISUAL MARKINGS AND METHOD FOR MANUFACTURING THEREOF

FIELD OF THE INVENTION

The invention relates to an identification document having at least a first visual marking and a second visual marking depicting a same identification data, the second visual marking being obtained by engraving an optically variable printing ink patch. The invention relates also to a method for manufacturing such an identification document.

The invention finds applications in the security field and, in particular, in the field of securing documents like identity cards or passports.

BACKGROUND

To prevent counterfeiting activities, an identification document such as an identification card, a driving license or a passport must have sufficient observable security features to allow quick visual verifications. Several security elements are generally used such as guilloches, holograms, etc. However, it's important in security field to stay one step ahead of counterfeiters, in particular with improved optical security elements.

One of the most recent improved optical security element is disclosed in the patent application No US 2012/0126525 A1. This patent application described an identification document comprising a first personalized visual marking arranged in a first area of the identification document and a second personalized visual marking arranged in a second area of the identification document. An example of such an identification document is represented on FIG. 1A. This identification document, referenced 10, comprises a first visual marking 14 at the first area 12 and a second visual marking 26 at the second area 22. Both visual marking 14, 26 depict the same identification data, namely the picture of the document owner. According to this patent application, the first visual marking 14 is a portrait photo of the document owner; the second visual marking 26 is a transfer element constituting a patch that is printed on the second area with an optically variable ink, such as the special optically variable ink named OVI® or other optically variable inks.

The OVI is a special printing ink whose colour changes with the observation angle and in particular an ink provided with suitable pigments changes from a dark colour to a light colour upon laser irradiation.

In this known technology, the first visual marking—named the positive marking—is obtained by burning the dark outline of the portrait photo with laser and leaving the light areas untouched. The second visual marking—named the negative marking—is obtained with a reverse process from the first visual marking: the second visual marking is made by lasering out the light areas and leaving the dark outline untouched. So, both visual markings depict the same portrait photo but with opposite effects.

However, with this technology, the visual markings are positioned on the top of the identification document and may be counterfeited with an appropriate laser device even if the counterfeiter should manipulate both visual markings in two different way.

Otherwise, it is known to incorporate a second visual marking in depth in the identification document, as represented in FIG. 1B. In such identification document 20, a first visual marking 21 is laser engraved in a first area on the top of the identification document and a second visual marking 22 is provided in a window in a second area of the identification document body. The first visual marking 21 is laser engraved into transparent layers that can be doped to be laser sensitive. The second visual marking 22 is obtained by ablation of a metal foil. Like in the above-described prior art, the first visual marking 21 is obtained by burning the dark outline of the owner portrait photo with laser in order to form a positive marking. The second visual marking 22 is obtained by ablating a metal foil within the window of the identification document in order to form a negative marking. Such a technology has the inconvenient of using metal foil which is cost expensive. An identification document with metal ablation of a metal foil is thus cost expensive.

However, replacing the metal foil within the window by an OVI printed patch like this one disclosed in the patent application US 2012/0126525 A1 is not realisable because, under the effect of engraving, the OVI bubbles and make the second visual marking unreadable.

SUMMARY OF THE INVENTION

In response to the above formulated problems of cost and counterfeit risks of the first and second visual markings of the known technology, the applicant is proposing a method for manufacturing an identification document with more secure optical elements wherein the first visual marking is engraved on the top layers of the identification document body and the second visual marking is engraved inside the identification document body.

According to a first aspect of the invention, invention concerns a method for manufacturing an identification document comprising a body with a first visual marking, characterized in that it comprises the following steps of:

- providing at least one see-through portion in a first area of the identification document; said see-through portion comprising openings through the body of the identification document wherein only transparent layers cross over the openings,
- providing an optically variable printing ink patch positioned in register with the openings of the see-through portion and laminated to at least one first transparent layer; and
- engraving the surface of the laminated optically variable printing ink patch through the see-through portion with a first laser beam for obtaining the first visual marking, said first laser beam having a power determined so that the laser beam does not fully penetrate the ink layer so that only the surface of the ink pigments is modified.

According to an aspect, the invention concerns a method for manufacturing an identification document comprising a body with a first visual marking, characterized in that it comprises the following steps of:

- providing at least one see-through portion in a first area of the identification document;
- providing an optically variable printing ink patch, laminated to at least one first transparent layer located in the see-through portion; and
- engraving the surface of the laminated optically variable printing ink patch with a first laser beam for obtaining the first visual marking, said first laser beam having a power determined so that the optically variable printing ink patch does not bubble during the engraving.

According to another aspect, the invention concerns a method for manufacturing an identification document comprising a body with a second visual marking, the first and the second visual markings depicting a same identification data. The method is characterized in that it comprises the following steps of:

engraving a second area of the identification document with a second laser beam for obtaining the second visual marking;

the first laser beam having a lower power than the second laser beam.

Such a method allows, among other advantages, to easily produce a secured and cost-effective identification document.

In the following description, it will be called "OVI patch" an optically variable ink (OVI) printed data area.

Advantageously, the optically variable printing ink patch is laminated between the first transparent layer and a second transparent layer.

Advantageously, the laminated optically variable printing ink patch comprises a first side in which the first visual marking is engraved and a second side in which a third marking is engraved.

Such a configuration allows, in particular, to produce two personalized identification data on a same OVI patch. The skilled person would understand that personalized identification data are data—for example a picture—which are printed with optically variable ink and laser engraved in order to modify the data such as printed.

According to one or more embodiments, the third marking is a personalized marking different from the first and the second visual markings.

According to one or more embodiments, the first marking can be a personalized marking different from the second and the third visual markings.

According to one or more embodiments, the second visual marking is personalized as a positive picture and the first visual marking is personalized as a negative picture of the same identification data.

According to another aspect, the invention concerns an identification document comprising a body with a first visual marking characterized in that said first visual marking is obtained by the method for manufacturing an identification document proposed by the present invention.

According to one or more embodiments, the body of the identification document comprises a second visual marking wherein the first and the second visual markings depicting same identification data.

According to one or more embodiments, the identification document comprising a body with a positive visual marking and a negative visual marking, the positive visual marking and the negative visual marking depicting a same identification data.

This identification document comprises:

a second area in which the second visual marking is engraved; and a first area comprising an optically variable printing ink patch laminated to at least one first transparent layer and constituting a see-through portion, the first visual marking being engraved at the surface of the laminated optically variable printing ink patch.

Such an identification document presents the advantage, among other advantages, to be difficult to be copied or counterfeit.

Advantageously, the optically variable printing ink patch is laminated between the first transparent layer and a second transparent layer and comprises a first side in which the first visual marking is engraved and a second side in which a third marking is engraved.

Advantageously, the third marking is a personalized marking different from the first and the second visual markings.

According to one or more embodiments, the second visual marking is a positive picture and the first visual marking is a negative picture of the same identification data.

BRIEF DESCRIPTION OF THE DRAWINGS

A detailed description of some preferred embodiments is set forth herein below with reference to the following drawings, in which.

DETAILED DESCRIPTION

Figure 1A:
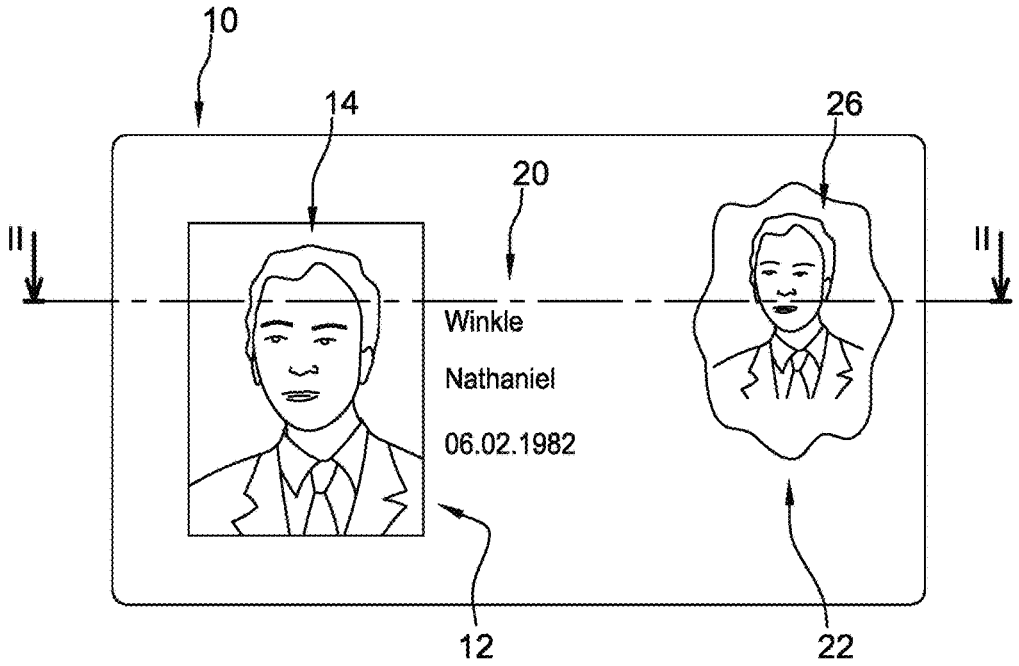
FIGS. 1A-1B, already disclosed, are top views of identification documents according to the prior art.
Figure 1B:
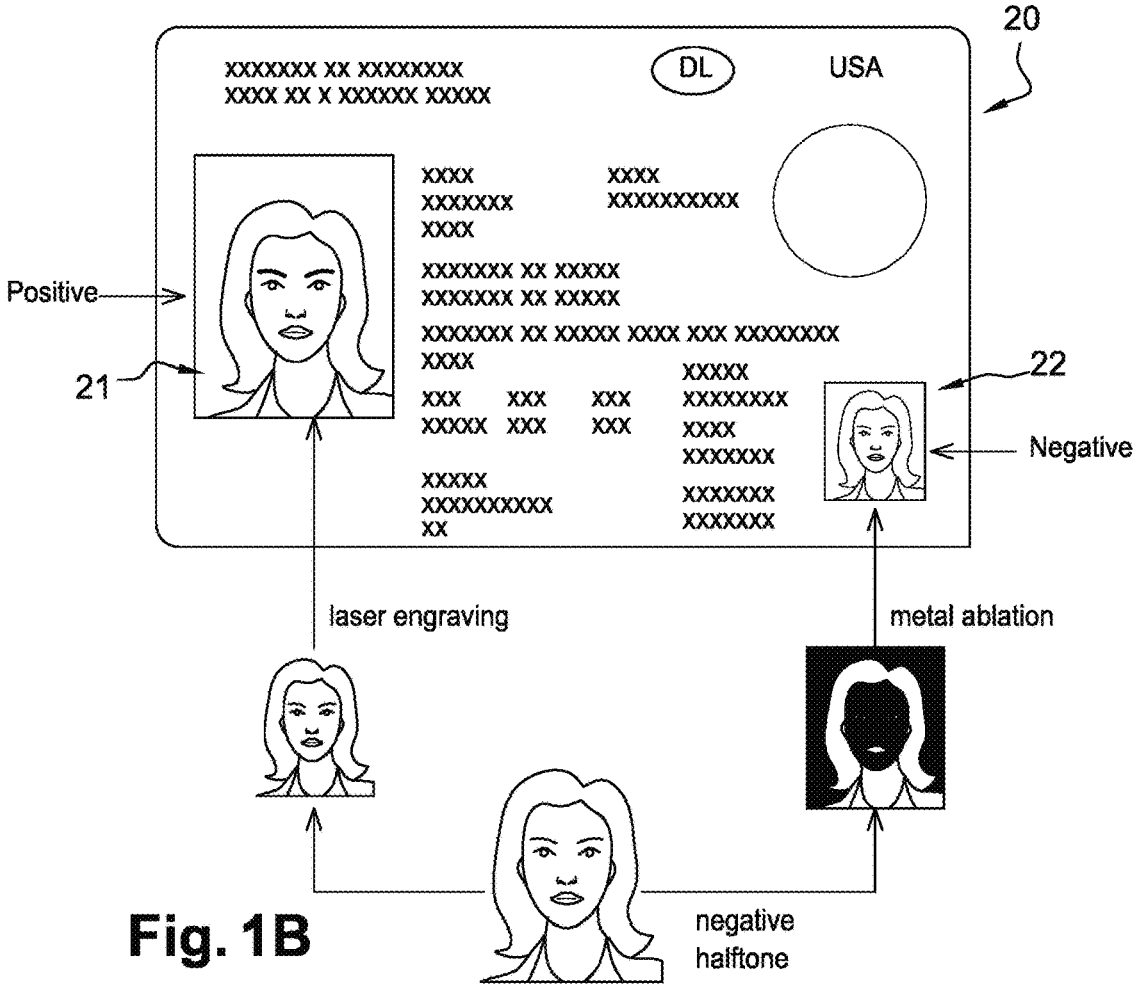

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example" means that a particular feature, structure, or characteristic described is included in at least one embodiment described herein and does not imply that the feature, structure, or characteristic is present in all embodiments described herein.

The invention is proposing a method wherein the second visual marking is an engraved optically variable printing ink patch, inserted inside the identification document body. For that, a see-through portion is provided in the identification document body—more simply named "body"—and an optically variable printing ink patch—named OVI patch—is laminated with at least one transparent layer located in the see-through portion. A cross-sectional view of a body 150 is represented on FIG. 2. This cross-sectional view is showing several transparent layers 101-105—for example transparent polycarbonate (PC) layers—shared over and under each opaque layer 111-112—for example opaque polycarbonate (PC) layer. Openings 121, 122 provided in each of the opaque layers 111,112 and superposed one with the other are constituting a window 120. The window 120 is a see-through portion in the body 150 wherein only transparent layers cross over the openings 121, 122.

According to the invention, the OVI patch 131 is laminated with at least one transparent layer, e.g. the transparent layer 101, within the window 120. The OVI patch 131 may be inserted at any location inside the window 120 and laminated with any of the transparent layers of the structure once it is under a transparent layer. The OVI patch 131 may be inserted at any location inside the window 120 and positioned in register with the openings of the windows. Further, the OVI patch 131 may have any shape, size and number in the document. An identification document may have for example several windows 120 with an OVI patch within each. One OVI patch 131 laminated with at least one transparent layer is named laminated OVI patch and is referenced 132. In the embodiment shown in FIG. 2, the OVI patch 131 is laminated between two transparent layers 101 and 102. Whatever the embodiment, the laminated OVI patch 132 is visible inside the window 120.

According to the invention, the surface of the laminated OVI patch 132 is engraved with a laser beam 200 in order to personalize the OVI patch and form the second visual marking 130. The OVI patch 131 is thus laser irradiated through the transparent layer 101. The engraving of the laminated OVI patch 132 is made with a low power laser beam represented by the arrow 200*a* on FIG. 2. Indeed, using a low power laser beam on a laminated OVI patch 132 allows the engraving of only the surface of the OVI patch 131 in order that only a part of the OVI pigments are irradiated. The low power laser beam do not fully penetrate the ink layer. In this way, since only the surface of the pigments is modified, the OVI patch 131 does not bubble under the laser irradiation effects.

The second visual marking 130 comprises an identification data, already marked on the body 150, but personalized in order to be different from the already marked identification data. The identification data may be for example a portrait picture of the owner of the identification document or any other picture, drawing or alphanumeric data relative to the owner of the identification document. This portrait picture may be marked in a first area of the body and form the first visual marking. The second visual marking may thus comprise the same portrait picture as the first visual marking but with a personalization made by laser engraving.

Figure 3:
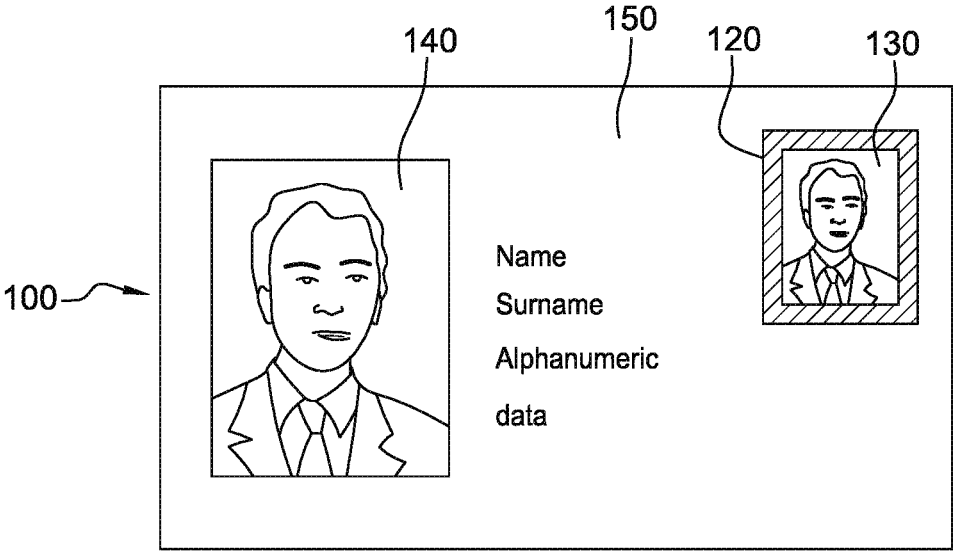
FIG. 3 is an example of a top view of an identification document according to the invention.

FIG. 3 represents an example of a top view of an identification document according to the invention. This identification document 100 comprises two visual markings:

- the first visual marking 140, at a first area, is a portrait picture of the document owner with, for example, a first personalization. This first visual marking 140 may be made with the same personalizing method than the first visual marking of the prior art. Thus, the first visual marking 140 is laser engraved into transparent layers whose at least one is doped in order to be laser sensitive. The first visual marking 140 of the invention is made by engraving the first area with a first laser beam at a usual power.
- the second visual marking 130, at a second area, is another personalization of the same portrait picture than the first visual marking 140. The second visual marking 130 is made, as indicated above, by engraving the laminated OVI patch 132 in the window 120. The engraving of the laminated OVI patch 132 is made with a second laser beam at a lower power than this used for the first visual marking.

According to the invention, the laser power of the first laser beam used for making the first visual marking 140 is higher than the laser power of the second laser beam used for personalizing the laminated OV patch 132. For example, the laser power for the first visual marking is selected so that the laser additive included in the document body plastic material layers is activated and resulting in blackening of the body material. Thus a full grayscale from white to black marking can be obtained. The laser power for the second visual marking—and the third visual marking described later—is selected low enough that the laser additive in the body plastic material layers is not activated but power is set high enough that the laser beam is able to ablate or thermally modify the pigments in the optically variable ink to produce the loss of the optically variable effect and not to cause material burning or bubble formation.

According to some embodiments, the first visual marking is a positive visual marking and the second visual marking is a negative visual marking. In the positive marking, the dark outline of the portrait picture is burned with laser and the light areas are untouched. On the opposite, in the negative marking, the light areas are lasered out and the dark outline is untouched.

Figure 2:
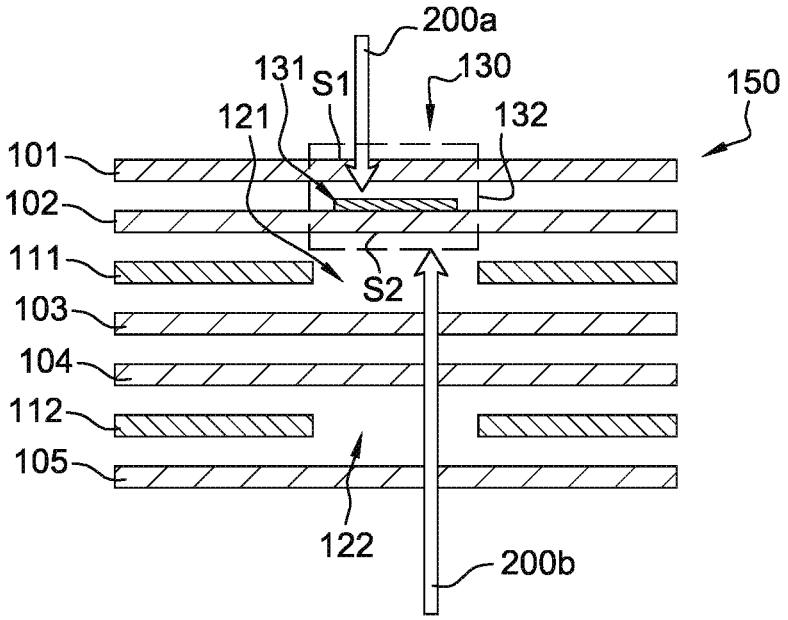
FIG. 2 is a cross-sectional view of an identification document according to the invention.

In the embodiment of FIG. 2, the OVI patch 131 is laminated between two transparent layers 101 and 102. In such an embodiment, the laminated OVI patch 132 comprises a first side S1 and a second side S2. The first side S1 is for example the side the nearest from the overtop of the body 150, the second side S2 being the opposite side of the laminated OVI patch 132 i.e. the side the nearest from the bottom surface of the body 150. In this embodiment, a third visual marking may be engraving by a third laser beam on the second side S2, as shown by the arrow 200*b*. Indeed, since only the surface of the first side S1 of the laminated OVI patch 132 is engraved for forming the second visual marking 130, the second side S2 of said laminated OVI patch 132 may be also engraved without generating any interaction with the second visual marking.

Figure 4A:
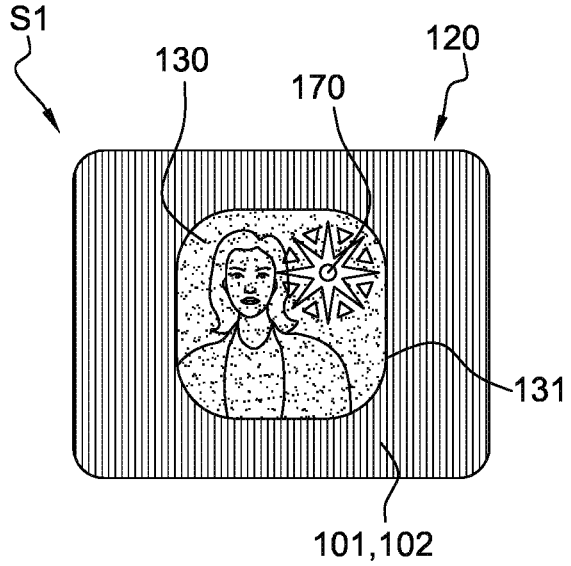
FIGS. 4A-4D are examples of front and rear views of the second visual marking according to the invention, under different lights.
Figure 4B:
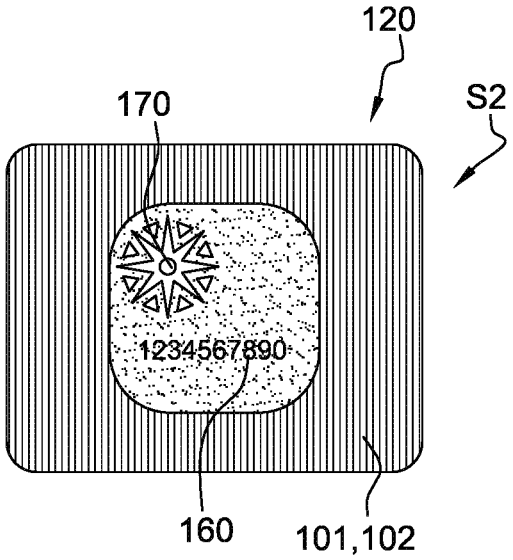
Figure 4D:
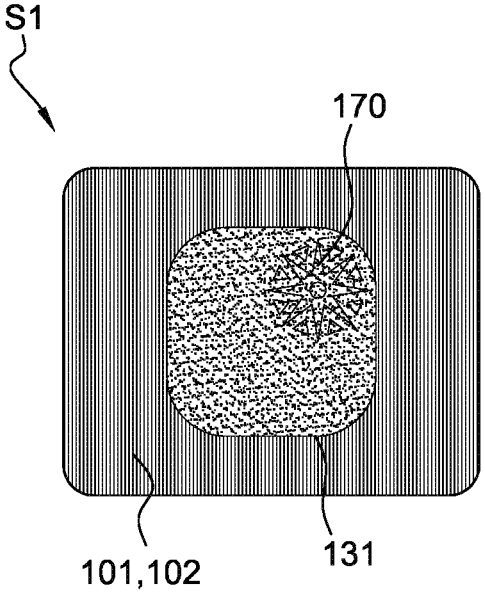

FIGS. 4A and 4B represent the first and the second visual markings of a same identification document. FIG. 4A shows an example of the second visual marking 130 in the window 120. FIG. 4B shows an example of a third visual marking 160 in the window 120. In this embodiment, the second visual marking 130 is a portrait picture of the identification document owner, personalized by laser engraving. The OVI patch 131 is a rounded rectangle laminated between two transparent layers 101, 102 and comprising the portrait picture. The laminated OVI patch first side S1 has been engraved by a low power laser beam. The third marking 160 is an identification data engraved on the laminated OVI patch second side S2 by the same low power laser beam as the first side. For example, the identification data of the third marking 160 may be alphanumeric data like the owner birthday date or the identity card number, etc.

In the embodiment of FIGS. 4A, 4B, the second and third visual markings 130, 160 form respectively the recto and the verso of the laminated OVI patch 132. Such an embodiment allows a double personalization of the laminated OVI patch within the window 120 without any of these personalizations interfere with the other. This double personalization is added to the personalisation with the first visual marking 140.

The skilled person would understand that data engraved on the laminated OVI patch could be indifferently a portrait picture or alphanumeric data or any other data, relative or not to the identification document owner, the data engraved on first side being identical to or different from these of second side.

Figure 4C:
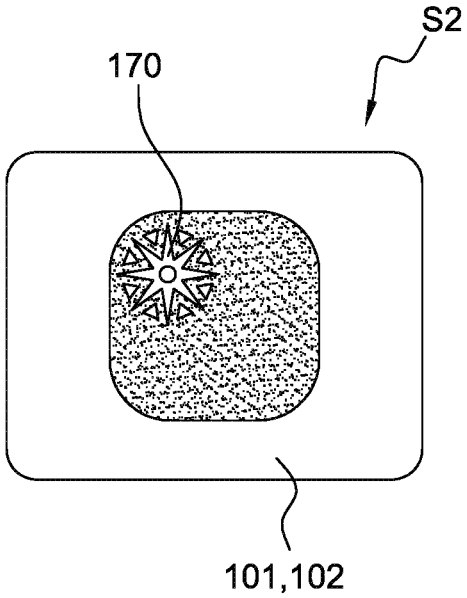

In the embodiment of FIGS. 4A and 4B, the OVI patch 131 comprises an ink opening 170. This ink opening 170 is visible on any of the first and second sides of the OVI patch, further enhancing the security of the identification document. An example of this ink opening 170 in a non-engraved OVI patch is shown in FIG. 4C. In this example, the ink opening 170 is a star that is visible in the window 120 on each side S1, S2 of the OVI patch 131. Therefore, the first side and the second side of the OVI patch 131 can be differently personalized while having a common element i.e. the ink opening 170.

As above disclosed, irradiating the laminated OVI patch 132 with a low power laser beam allows several advantages. One supplemental advantage is that the visual perception of the marking varies depending of the light wavelength. FIGS. 4A to 4D represent the laser engraved OVI patch under several light wavelengths. For example, a personalized portrait picture is visible on the first side S1 of the OVI patch under a normal light (in the range of about 400 to 700 nm), as shown in FIG. 4A. Further, under a light of about 850 nm, the marking, like the engraved numeric data of the second side S2 of the OVI patch, is visible as shown in FIG. 4B. On the opposite, under UV light (between 10 and 400 nm), the personalization is not visible as shown on FIG. 4D. Furthermore, under a strong transmissive light, such as visible light between about 400 and 700 nm, the numeric data on the second side S2 is not visible even if the ink opening is visible, as shown in FIG. 4C. Whatever the embodiment, the identification document according to the invention allows at least one double personalization of the identification data, getting more yet difficult the counterfeiting of the identification document, with a manufacturing low cost.

While only some selected embodiments have been chosen to illustrate the present invention, it will be apparent to the skilled person from this disclosure that various changes and modifications can be made herein without departing from the scope of the invention as defined in the appended claims. The structures and functions of one embodiment can be adopted in another embodiment. Further, it is not necessary for all advantages to be present in particular embodiments at the same time.

The invention claimed is:

1. A method for manufacturing an identification document comprising a body with a first visual marking, comprising:

providing at least one see-through portion in a first area of the identification document; said see-through portion comprising openings through the body of the identification document wherein only transparent layers cross over the openings, providing an optically variable printing ink patch positioned in register with the openings of the see-through portion, and laminated to at least one first transparent layer between the first transparent layer and a second transparent layer; and engraving the surface of the laminated optically variable printing ink patch through the see-through portion with a first laser beam for obtaining the first visual marking, said first laser beam having a power determined so that the laser beam does not fully penetrate the ink layer so that only the surface of the ink pigments is modified;

wherein the laminated optically variable printing ink patch comprises a first side in which the first visual marking is engraved and a second side in which a second marking is engraved through the see-through portion with the first laser beam.

2. The method for manufacturing an identification document according to claim 1, wherein the body comprises a third visual marking, the first and the third visual markings depicting same identification data, further comprising:

engraving a second area of the identification document with a second laser beam for obtaining the third visual marking;

said first laser beam having a lower power than the second laser beam.

3. The method according to claim 1, wherein the third visual marking is personalized as a positive picture and the first visual marking is personalized as a negative picture of the same identification data.

4. The method according to claim 1, wherein the second marking is a personalized marking different from the first and the second visual markings.

5. An identification document comprising a body with a first visual marking by:

providing at least one see-through portion in a first area of the identification document; said see-through portion comprising openings through the body of the identification document wherein only transparent layers cross over the openings, providing an optically variable printing ink patch positioned in register with the openings of the see-through portion and laminated to at least one first transparent layer between the first transparent layer and a second transparent layer; and engraving the surface of the laminated optically variable printing ink patch through the see-through portion with a first laser beam for obtaining the first visual marking, said first laser beam having a power determined so that the laser beam does not fully penetrate the ink layer so that only the surface of the ink pigments is modified;

wherein the laminated optically variable printing ink patch comprises a first side in which the first visual marking is engraved and a second side, opposite the first side and having a second laser-engraved marking.

6. The identification document according claim 5 wherein the body comprises a third visual marking, the first and the third visual markings depicting same identification data.

7. The identification document according to claim 5, wherein the third visual marking is a positive picture and the first visual marking is a negative picture of the same identification data.

8. The identification document according to claim 5, wherein it comprises:

a second area in which the third visual marking is engraved with a second laser beam.

9. The identification document according to claim 5, wherein the second marking is a personalized marking different from the first and the third visual markings.

10. An identification document comprising:

a body having:

at least one see-through portion in a first area of the identification document; said see-through portion comprising openings through the body of the identification document wherein only transparent layers cross over the openings, an optically variable printing ink patch positioned in register with the openings of the see-through portion, and laminated to at least one first transparent layer between the first transparent layer and a second transparent layer; and a first laser-engraved visual marking on the surface of the laminated optically variable printing ink patch;

wherein the laminated optically variable printing ink patch comprises a first side in which the first visual marking is engraved and a second side, opposite the first side and having a second laser-engraved marking.

11. The identification document according claim 10 wherein the body comprises an additional visual marking, the first laser-engraved visual marking and the additional visual marking depicting same identification data.

12. The identification document according to claim 11, wherein the body further comprises a second area in which the additional visual marking is engraved.

13. The identification document according to claim 10, wherein the additional visual marking is a positive picture and the first laser-engraved visual marking is a negative picture of the same identification data.

14. The identification document according to claim 10, wherein the second laser-engraved visual marking is a personalized marking different from the first laser-engraved visual marking and the additional visual marking.

* * * * *